US005926074A

United States Patent [19]

Ohira et al.

[11] Patent Number: 5,926,074

[45] Date of Patent: Jul. 20, 1999

[54] NONRECIPROCAL CIRCUIT DEVICE

[75] Inventors: Katuyuki Ohira, Ohtsu; Yutaka Ishiura, Kyoto; Hiromu Tokudera, Nagaokakyo, all of Japan

[73] Assignee: Murata Manufacturing Co., Ltd., Japan

[21] Appl. No.: 09/006,146

[22] Filed: Jan. 13, 1998

[30] Foreign Application Priority Data

Jan. 14, 1997 [JP] Japan ..... 9-04934

[51] Int. Cl.[6] ..... H01P 1/383

[52] U.S. Cl. ..... 333/1.1; 333/24.2

[58] Field of Search ..... 333/1.1, 24.2

[56] References Cited

U.S. PATENT DOCUMENTS 5,498,999 3/1996 Marusawa et al. ..... 333/1.1

5,774,024 6/1998 Marusawa et al. ..... 333/1.1

*Primary Examiner*—Paul Gensler

*Attorney, Agent, or Firm*—Ostrolenk, Faber, Gerb & Soffen, LLP

[57] ABSTRACT

A nonreciprocal circuit device with a plurality of central conductors each formed of a respective plurality of laminated strip conductors extending in the same direction. The central conductors overlap with each other at a specified angle. A ferrite is disposed where the central conductors overlap, and a DC magnetic field is applied to the overlapping portion. The strip conductors constituting two central conductors among the plurality of central conductors may be alternately laminated. Or, the strip conductors constituting one central conductor may sandwich those of another central conductor, to achieve strong electromagnetic coupling.

13 Claims, 7 Drawing Sheets

NONRECIPROCAL CIRCUIT DEVICE

BACKGROUND OF THE INVENTION

1. Field of the Invention

The present invention relates to nonreciprocal circuit devices, and more particularly, to a structure of a microwave nonreciprocal circuit device for use as an isolator or a circulator.

2. Description of the Related Art

In general, in an isolator or a circulator, a signal is passed only in a transfer direction and opposite-direction signal transfer is blocked. They are, for example, employed in transmitting and receiving circuit sections of mobile communication equipment such as a portable telephone or a car telephone. It has been increasingly demanded that an isolator and a circulator used for this purpose have advanced performance.

FIG. 8 is an exploded perspective view of a central electrode assembly of a three-port-type isolator which has been used. A central electrode assembly 101 has a structure in which central conductors 103 to 105 are formed on the upper surfaces of insulating layers 102 which in whole or in part are made from ferrite. The insulating layers 102 are laminated such that the central conductors 103 to 105 overlap with each other at an angle of about 120 degrees, and the insulating layers are sandwiched by a pair of ferrites 106. The central conductors 103 to 105 are each formed of one strip conductor as shown in the figure and serve as ports.

To increase the Q value of a conductor, it is demanded that the thickness of each of the strip conductors 103 to 105 be more than about three times the skin depth. In the structure described above, however, if strip conductors are formed such that the thickness is more than three times the skin depth, large gaps are formed between the various layers 102 and 106 when the layers are laminated and they are likely to break.

To solve the foregoing problem, a method has been proposed in which a central conductor serving as a port is formed of a plurality of strip conductors on respective insulating layers. The strip conductors and insulating layers are sequentially laminated for each central conductor as shown in FIG. 9. With this method, even if the thickness of one strip conductor is not more than three times the skin depth, because a plurality of strip conductors are laminated, the same Q value is obtained as in a case when the conductor is formed to have the required thickness. Therefore, the thickness of each strip conductor can be small, while the required Q value is obtained, and the risk of breakage of an insulating layer is eliminated.

The above conventional nonreciprocal circuit device, however, has a problem: The coupling between central conductors is weak. FIG. 10 is a view showing a typical coupling condition between strip conductors in a nonreciprocal circuit device. In FIG. 10, the solid lines with arrows indicate a magnetic field formed by strip conductors 113*a* and 113*b*. The magnetic field is stronger at points closer to the strip conductors 113*a* and 113*b* and is weaker at points farther from the strip conductors. When a central conductor 113 and a central conductor 114 are magnetically coupled in this structure, since the magnetic field formed by the strip conductors 113*a* and 113*b* is weak near the strip conductors constituting the central conductor 114, especially near the strip conductor 114*b*, the magnetic coupling between the central conductors 113 and 114 becomes weak. Capacitive coupling C is achieved only between the strip conductor 113*b* and the strip conductor 114*a*, between the two central conductors 113 and 114.

As described above, electromagnetic coupling is generally weak between the two central conductors and the insertion loss of the central conductors becomes large.

SUMMARY OF THE INVENTION

To address this problem, the present invention is able to provide a nonreciprocal circuit device having improved coupling between central conductors.

The foregoing may be achieved according to one aspect of the present invention through the provision of a nonreciprocal circuit device in which a plurality of central conductors are each formed of a plurality of laminated strip conductors extending in the same direction, the plurality of central conductors overlapping with each other at specified angles. A ferrite is disposed where the plurality of central conductors overlap, and a DC magnetic field is applied to the overlapping portion. A first central conductor and a second central conductor among the plurality of central conductors are disposed such that the respective strip conductors constituting the first central conductor and the respective strip conductors constituting the second central conductor are alternately laminated.

The foregoing can also be achieved according to another aspect of the present invention through the provision of a nonreciprocal circuit device in which a plurality of central conductors are each formed of a plurality of laminated strip conductors extending in the same direction, the plurality of central conductors overlapping with each other at specified angles. A ferrite is disposed where the plurality of central conductors overlap, and a DC magnetic field is applied to the overlapping portion. One central conductor among the plurality of central conductors is laminated such that its respective strip conductors sandwich the respective strip conductors of another central conductor.

Therefore, electromagnetic coupling between intended central conductors is made stronger than in the known devices, and the amount of coupling between the central conductors is increased.

DESCRIPTION OF EMBODIMENTS OF THE INVENTION

Figure 1:
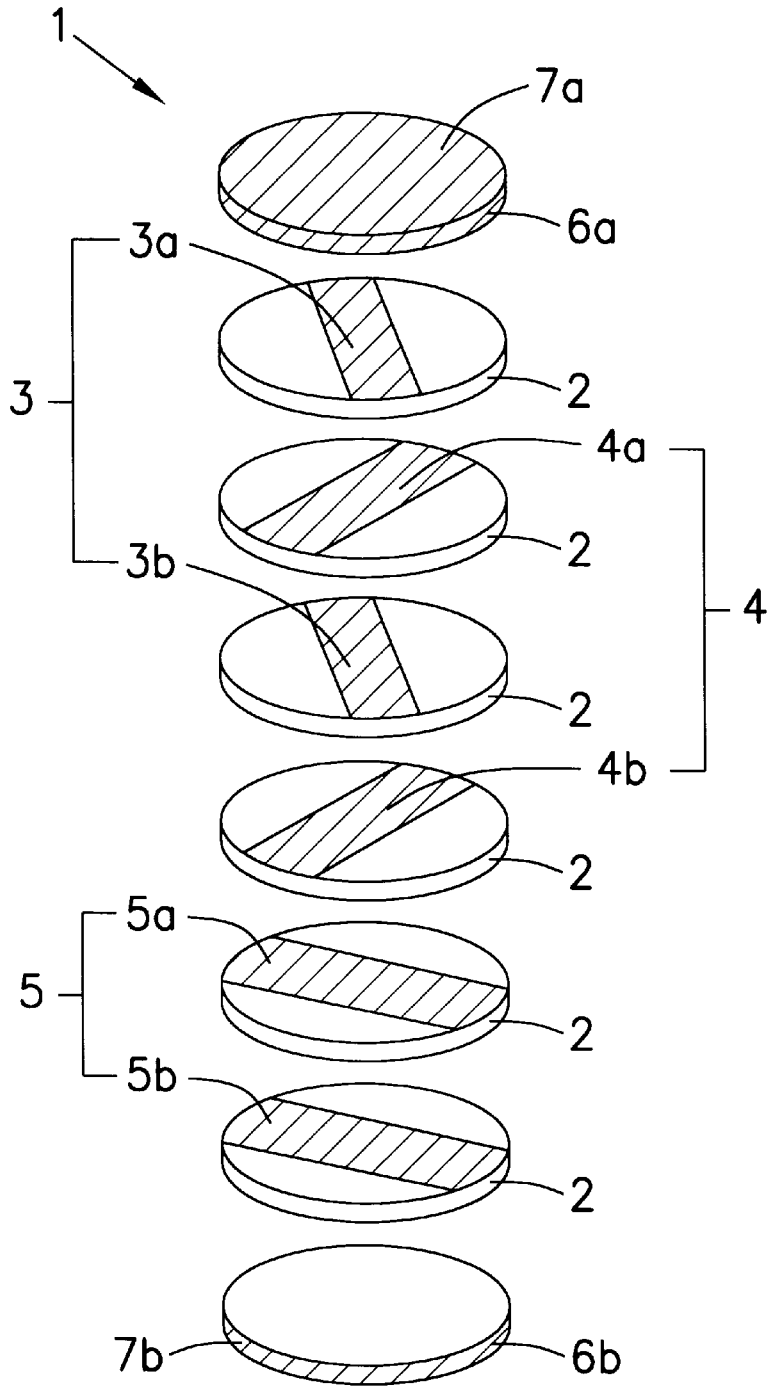
FIG. 1 is an exploded perspective view showing a central electrode assembly of a nonreciprocal circuit device according to a first embodiment.

Embodiments of the present invention will be described below in detail by referring to the drawings.

A lumped-constant three-port isolator according to a first embodiment will be described below.

Figure 2:
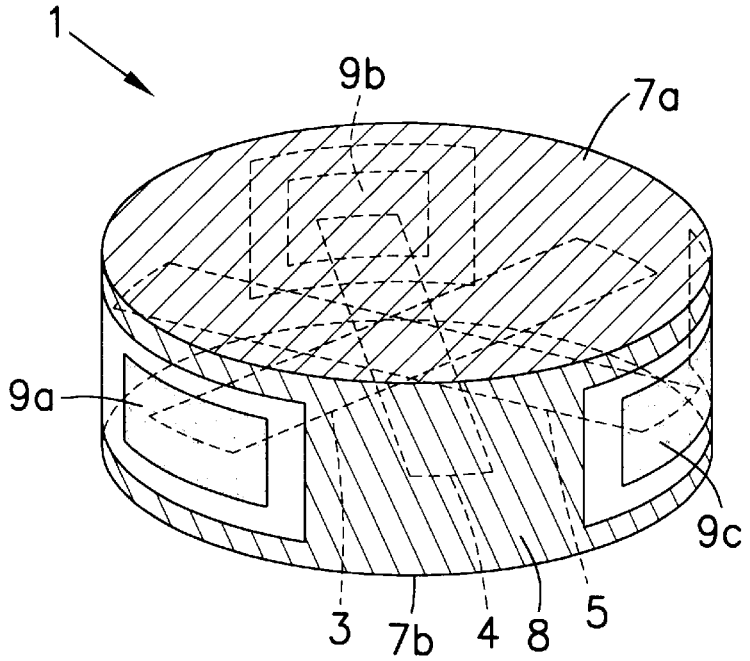
FIG. 2 is a perspective view of the central electrode assembly of the nonreciprocal circuit device according to the first embodiment.

FIG. 1 is an exploded perspective view of a central electrode assembly 1 of the isolator. Central conductors 3 to 5 are each formed of two strip conductors, namely 3*a* and 3*b*, 4*a* and 4*b*, and 5*a* and 5*b*, respectively, and are laminated so that they overlap with each other at an angle of 120 degrees. Ferrites 6*a* and 6*b* are disposed over and under the central conductors (as shown in FIGS. 1 and 2). On the outer surfaces of the ferrites 6*a* and 6*b*, ground electrodes 7*a* and 7*b* are formed. On the side face of the central electrode assembly 1, a ground electrode 8 is formed. The ground electrodes 7*a* and 7*b* are connected to each other via the ground electrode 8.

Referring to FIG. 2, on the outer peripheral surface of the central electrode 1, input and output terminal electrodes 9*a*, 9*b*, and 9*c* which are insulated from the ground electrode 8 are formed. Among the input and output terminal electrodes, one terminal electrode 9*c* is connected to a terminating resistor (not shown). When the terminal electrode 9*c* is connected to an external circuit without this terminating resistor being connected, the isolator functions as a circulator.

First ends of the central conductors 3 to 5 are connected to the ground electrode 8. Second ends of the central conductors 3 to 5 are connected to the input and output terminal electrodes 9*a*, 9*b*, and 9*c*, respectively.

The central electrode assembly 1 is accommodated in a magnetic yoke (not shown) constituting a magnetic closed circuit. A permanent magnet (not shown) is disposed in the yoke and it applies a DC magnetic field to the axial center of the ferrites 6*a* and 6*b* to form an isolator.

The strip conductors 3*a*, 3*b*, 4*a*, 4*b*, 5*a*, and 5*b* are formed by pattern printing on respective insulating layers 2. These insulating layers 2 are laminated to form the central electrode assembly 1. Strip conductors constituting two central conductors to be coupled are alternately laminated. Specifically, in the isolator of the present embodiment, to strongly couple the central conductor 3 with the central conductor 4, strip conductors 3*a*, 4*a*, 3*b*, and 4*b* are laminated in this order from the top, and then conductors 5*a* and 5*b* are laminated in this order.

Figure 3:
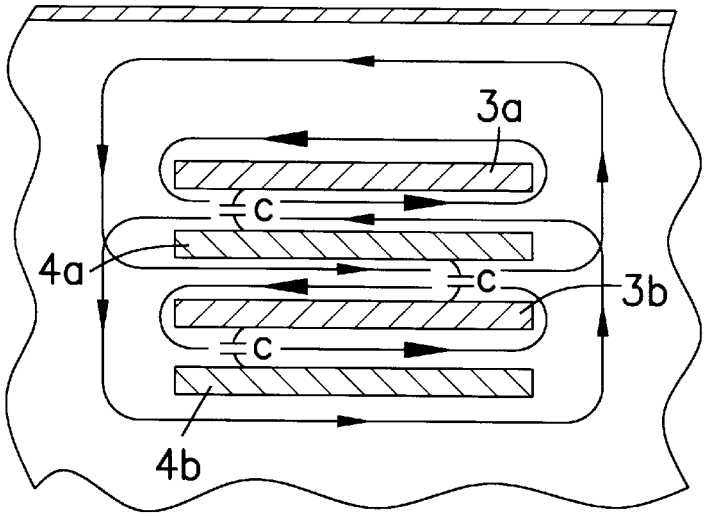
FIG. 3 is a simplified conceptual diagram showing the condition of electromagnetic coupling generated at the central electrode assembly of the nonreciprocal circuit device according to the first embodiment.

FIG. 3 is a simplified conceptual diagram indicating the condition of the electromagnetic coupling in the isolator of the first embodiment. Since the strip conductors are laminated in the foregoing order, the conductors 4*a* and 4*b* are disposed in respective locations where the conductors 3*a* and 3*b* form a strong magnetic field. In addition, since the respective facing areas of the central conductors 3 and 4 to be coupled are larger than in the known devices, a strong capacitive coupling C is obtained.

A nonreciprocal circuit device according to the present invention is not limited to that in the above embodiment. For example, although the central conductors are each formed of two strip conductors in the above embodiment, they may each be formed of three or more strip conductors.

In the above embodiment, the central conductor 3 and the central conductor 4 are strongly electromagnetically coupled as an example. The present invention can also be applied to a case in which the central conductor 3 is strongly coupled with the central conductor 5, or to a case in which the central conductor 4 is strongly coupled with the central conductor 5.

For example, the strip electrodes may be stacked in the order 3*a*, 5*a*, 3*b*, 5*b*, 4*a*, 4*b*; or the order 3*a*, 3*b*, 4*a*, 5*a*, 4*b*, 5*b*; or the order 3*a*, 4*a*, 5*a*, 3*b*, 4*b*, 5*b*. In the latter case, the central conductors 3, 4 and 5 are all strongly coupled with each other.

Figure 4:
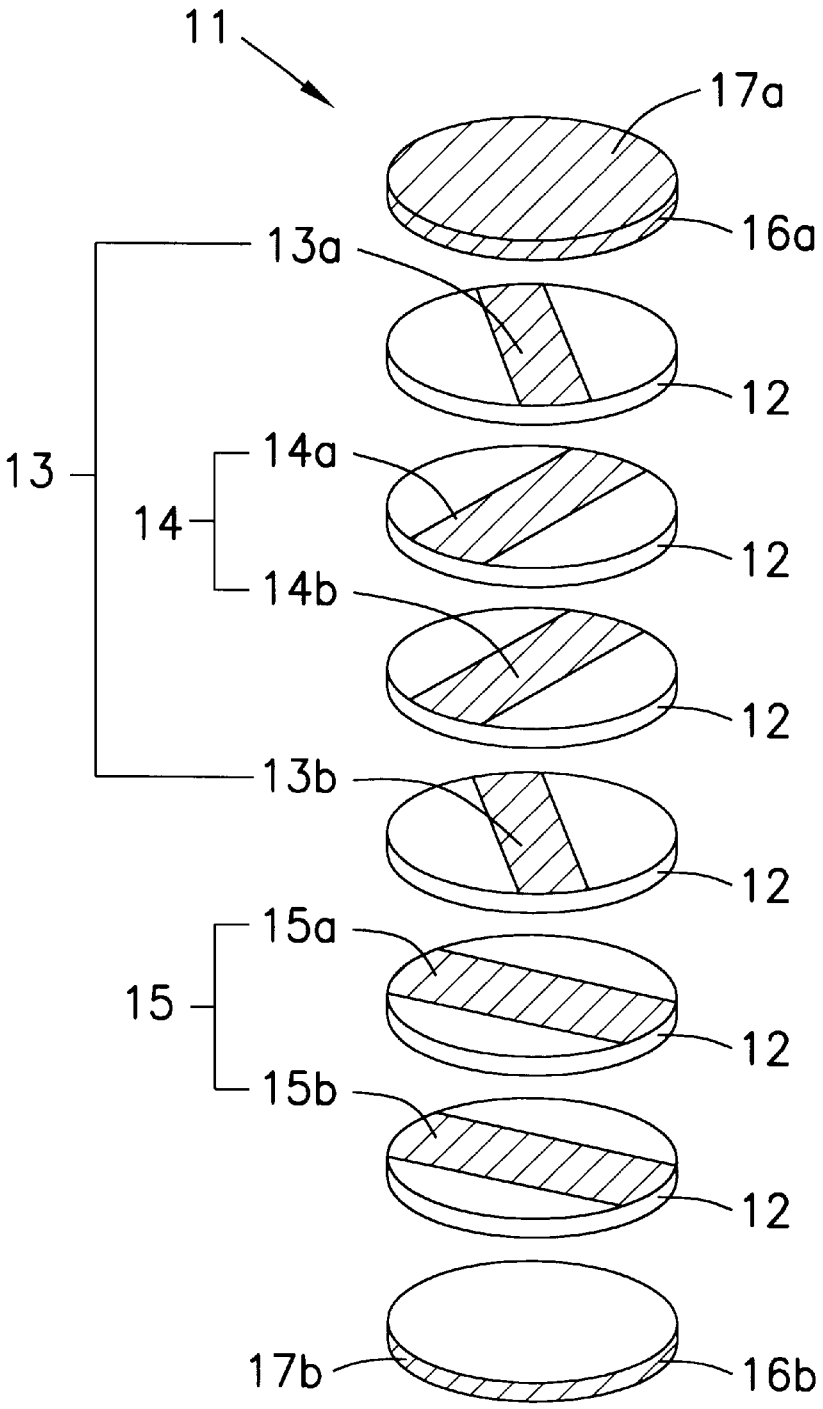
FIG. 4 is an exploded perspective view showing a central electrode assembly of a nonreciprocal circuit device according to a second embodiment.

A central electrode assembly 11 of an isolator according to a second embodiment of the present invention is shown in FIG. 4. It differs from that in the first embodiment in the order in which the strip conductors constituting the central conductors are laminated. In other words, in two central conductors which are to be strongly coupled, the strip conductors constituting one of the central conductors are laminated so as to sandwich both of the strip conductors constituting the other central conductor. Specifically, in order to strongly couple a central conductor 13 with a central conductor 14, strip conductors 13*a*, 14*a*, 14*b*, 13*b*, 15*a*, and 15*b* are laminated in this order.

Figure 5:
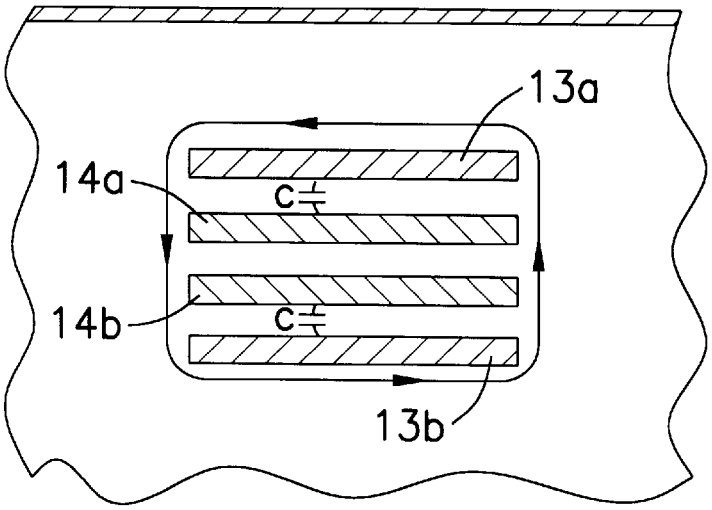
FIG. 5 is a simplified conceptual diagram showing the condition of electromagnetic coupling generated at the central electrode assembly of the nonreciprocal circuit device according to the second embodiment.
Figure 10:
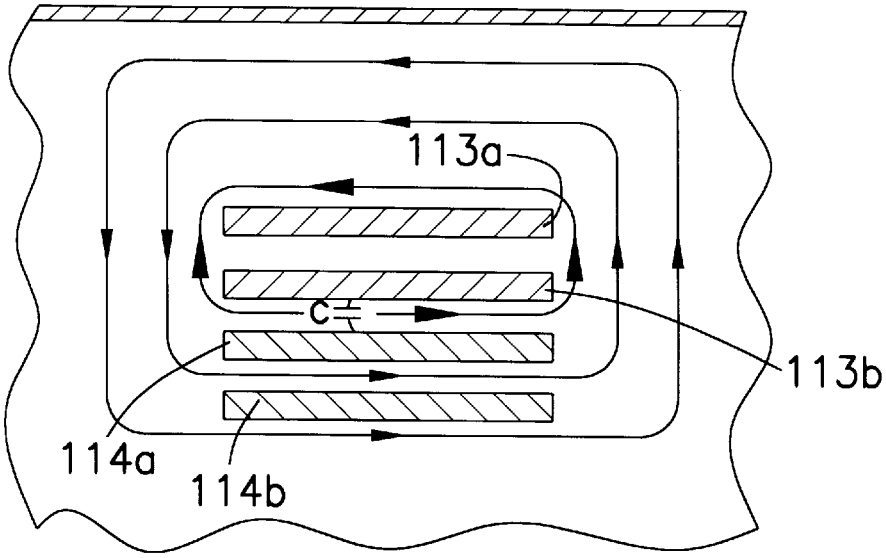
Fig. 10 Prior Art
FIG. 10 is a simplified conceptual diagram showing the condition of electromagnetic coupling generated at the central conductors of the conventional nonreciprocal circuit device shown in FIG. 9.

FIG. 5 is a simplified conceptual diagram indicating the condition of the electromagnetic coupling in the isolator of the second embodiment. Since the strip conductors are laminated in the foregoing order, the conductors 14*a* and 14*b* are disposed in a location where the conductors 13*a* and 13*b* form a strong magnetic field. In addition, since the respective facing areas of the central conductors 13 and 14 to be coupled are larger than in the known devices, strong capacitive coupling C is obtained.

Since the other configurations are the same as those in the first embodiment, the description thereof will be omitted.

Figure 6:
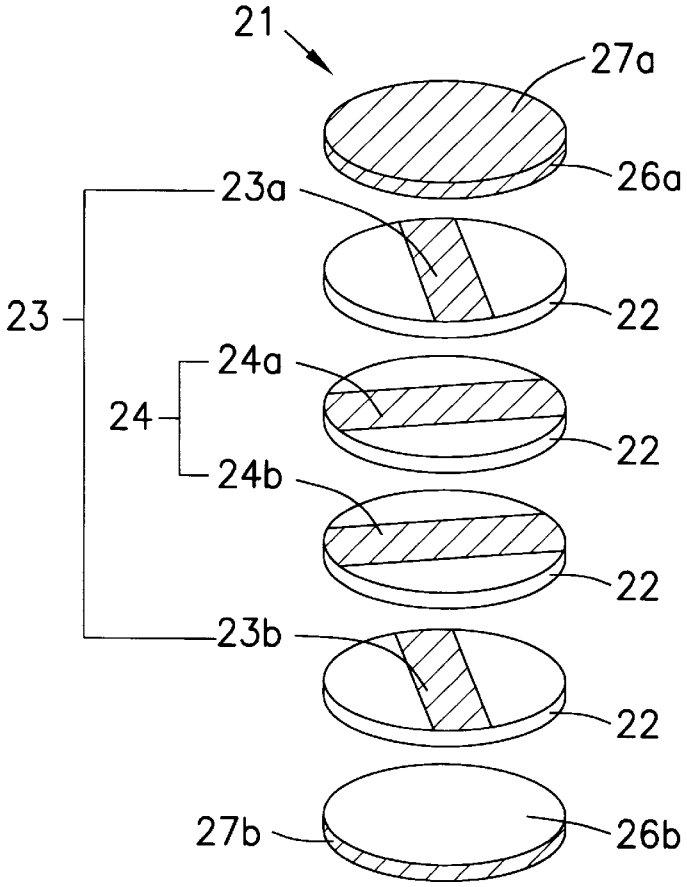
FIG. 6 is an exploded perspective view showing a central electrode assembly of a nonreciprocal circuit device according to a modification of the second embodiment.
Figure 8:
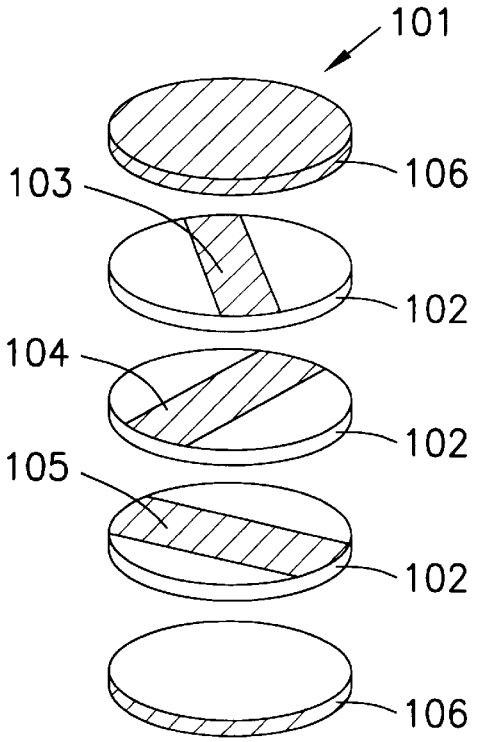
Fig. 8 Prior Art
FIG. 8 is an exploded perspective view showing central conductors of a conventional nonreciprocal circuit device.
Figure 7A:
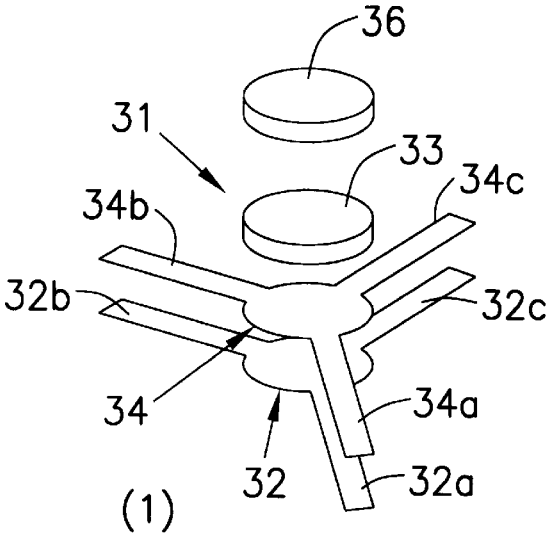
FIG. 7 is an exploded perspective view showing a central electrode assembly of a nonreciprocal circuit device according to a third embodiment. Steps in the process by which the strip conductors are laminated are sequentially shown as steps (1) to (4).
Figure 7B:
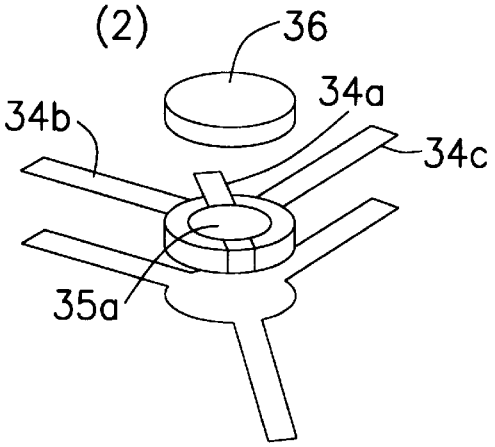
Figure 7C:
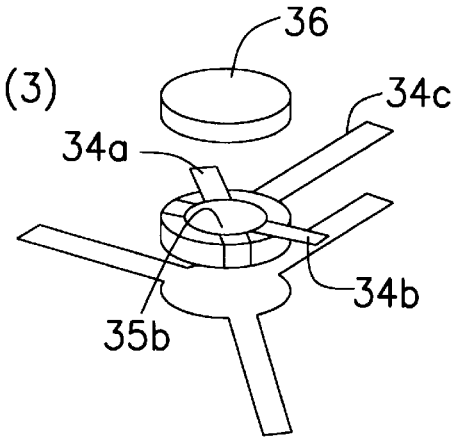
Figure 7D:
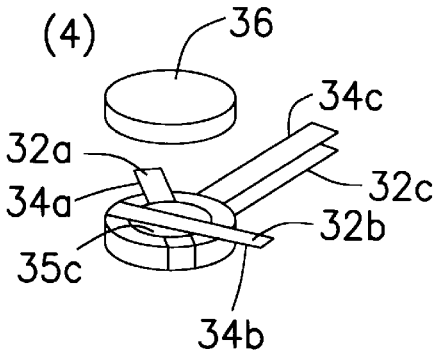
Figure 9:
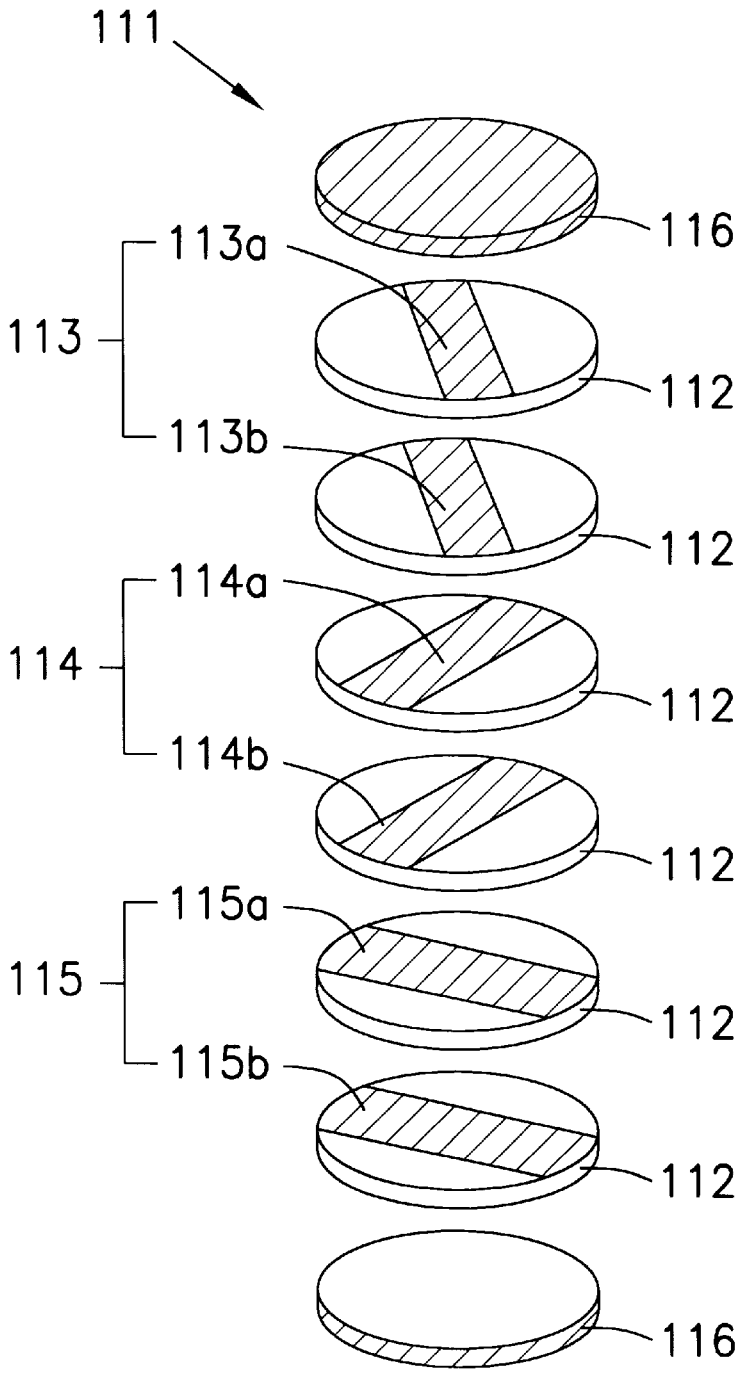
Fig. 9 Prior Art
FIG. 9 is an exploded perspective view showing central conductors of another conventional nonreciprocal circuit device.

A nonreciprocal circuit device according to the present invention is not limited to a three-port isolator or a three-port circulator. As shown in FIG. 6, when the present invention is applied to a two-port isolator, strip conductors 23*a*, 24*a*, 24*b*, and 23*b* are laminated in this order to strongly couple a central conductor 23 with a central conductor 24. In a two-port isolator, central conductors overlap with each other at an angle of about 180 degrees.

Referring now to FIG. 7, a central electrode assembly 31 of an isolator according to a third embodiment of the present invention comprises a ferrite assembly. The ferrite assembly is formed as shown in FIG. 7 such that a circular ferrite 33 is disposed at the center of two conductive plates 32, 34 each of which is integrated with three strip conductors 32*a*, 32*b*, and 32*c*, and 34*a*, 34*b*, and 34*c*, respectively. The strip conductors 32*a*, 32*b*, 32*c*, 34*a*, 34*b* and 34*c* are folded onto the upper surface of the ferrite 33 with insulating sheets 35*a*, 35*b*, 35*c*, etc., therebetween and overlap with each other at an angle of 120 degrees.

The strip conductors are folded onto the surface of the ferrite 33 such that they are laminated in the same order as that in the first embodiment or the second embodiment or the modified embodiments thereof.

A second ferrite 36 is located above the ferrite 33 in FIG. 7, completing the central electrode assembly 31.

FIG. 7 shows steps numbered (1) to (4) in the process of assembling the central electrode assembly 31. As shown in step (2), first the strip conductor 34*a* is folded across the surface of the ferrite 33 and covered with an insulating sheet 35*a*. Then as shown in step (3), the strip conductor 34*b* is folded across the surface of the ferrite 33 and covered with an insulating sheet 35*b*. Two succeeding assembly operations are shown in step (4). First the strip conductor 32*a* is folded and covered with a corresponding insulating sheet 35*c*. Next the strip conductor 32*b* is folded, thus obtaining the structure shown in step (4) of FIG. 7.

As shown, the strip conductor 32*b* has not yet been covered with an insulating sheet and the strip conductors 32*c* and 34*c* have not yet been folded. After these operations have been done, the result will be a structure according to the first embodiment of the invention shown in FIG. 1. That is, a first pair of strip conductors 32*a*, 34*a* are assembled alternately with another pair of strip conductors 32*b* and 34*b*, similarly to the arrangement of the central conductors 3 and 4 in FIG. 1. Then, another pair of strip conductors 32*c*, 34*c* is assembled, similarly to the central conductor 5 in FIG. 1.

As described above, the present invention can be applied not only to the case in which the central electrode assembly is formed by laminating the strip electrodes and the insulating layers, as shown in FIGS. 1–6 , but also to the case in which the central electrode assembly is formed by the use of the ferrite assembly, as shown in FIG. 7.

Further, an embodiment wherein each central conductor comprises three or more strip conductors may combine features of both the first and second embodiments. For example, if a central conductor X comprises strip conductors X1, X2 and X3 and a central conductor Y comprises strip conductors Y1, Y2 and Y3, the respective strip conductors may be stacked in the order X1, Y1, Y2, X2, Y3, X3. That is, the strip conductors Y2, X2, Y3 and X3 are stacked alternately as in the first embodiment, while the strip conductors X1 and X2 sandwich the conductors Y1 and Y2 as in the second embodiment.

As described above, in a nonreciprocal circuit device according to the present invention, coupling between intended central conductors is made stronger than in conventional devices, whereas the required Q value is maintained, and as a result, the insertion loss of the central conductors is reduced.

As a converse effect of strengthened coupling between the intended central conductors, coupling between the other central conductors is weakened. As a result, when the present invention is applied to a three-port isolator, for example, coupling between a reflected signal and a central conductor connected to a terminating resistor is weakened, whereby a load of the terminating resistor is reduced.

In addition, since a nonreciprocal circuit device according to the present invention can be made by changing the order in which the strip conductors constituting a conventional nonreciprocal circuit device are laminated, conventionally used processes such as a strip-conductor forming process and an insulating-layer laminating process can be used with great economic efficiency.

What is claimed is:

1. A central electrode assembly for a nonreciprocal circuit device, comprising:

a stacked plurality of central conductors, each central conductor being formed of a respective plurality of strip conductors extending in a same direction, said plurality of central conductors overlapping with each other so as to define predetermined angles therebetween, a ferrite disposed at an overlapping portion of said plurality of central conductors, said central electrode assembly being adapted to receive a DC magnetic field applied to said overlapping portion, wherein a first central conductor and a second central conductor among said plurality of central conductors are disposed with the strip conductors constituting said first central conductor and the strip conductors constituting said second central conductor being alternately stacked.

2. A central electrode assembly according to claim 1, further comprising a third central conductor overlapping said first and second central conductors so as to define predetermined angles therebetween.

3. A central electrode assembly according to claim 2, wherein said third central conductor is formed of a respective plurality of strip conductors extending in a same direction, said strip conductors of said third central conductor being stacked sequentially but not alternately with said respective strip conductors of said first and second central conductors.

4. A central electrode assembly according to claim 1, further comprising a second ferrite disposed opposite said ferrite so as to sandwich said overlapping portion of said plurality of central conductors.

5. A central electrode assembly for a nonreciprocal circuit device, comprising:

a stacked plurality of central conductors, each central conductor being formed of a respective plurality of strip conductors extending in a same direction, said plurality of central conductors overlapping with each other so as to define predetermined angles therebetween, a ferrite disposed at an overlapping portion of said plurality of central conductors, said central electrode assembly being adapted to receive a DC magnetic field applied to said overlapping portion, wherein one central conductor among said plurality of central conductors is disposed with the strip conductors constituting said one central conductor being stacked so as to sandwich the strip conductors of another one of said plurality of central conductors.

6. A central electrode assembly according to claim 5, further comprising a third central conductor overlapping said one and said other central conductors so as to define predetermined angles therebetween.

7. A central electrode assembly according to claim 6, wherein said third central conductor is formed of a respective plurality of strip conductors extending in a same direction, said strip conductors of said third central conductor being stacked sequentially with but not sandwiched between said respective strip conductors of said one and said other central conductors.

8. A central electrode assembly according to claim 5, further comprising a second ferrite disposed opposite said ferrite so as to sandwich said overlapping portion of said plurality of central conductors.

9. A central electrode assembly for a nonreciprocal circuit device, comprising:

first and second conductor plates, each said conductor plate having a central portion and a respective plurality of strip conductors extending radially therefrom so as to define predetermined angles therebetween;

said first and second conductor plates being stacked with a ferrite, said ferrite being disposed adjacent to said stacked central portions;

said respective pluralities of strip conductors being paired, each pair of strip conductors being folded to extend across a surface of said ferrite opposite to said central portions of said conductor plates;

said strip conductors forming a stacked plurality of central conductors, each central conductor being formed of a respective said pair of strip conductors extending in a same direction, said plurality of said central conductors overlapping with each other to define said predetermined angles therebetween;

said ferrite being disposed at an overlapping portion of said plurality of central conductors, said central electrode assembly being adapted to receive a DC magnetic field applied to said overlapping portion, wherein the strip conductors constituting one of said plurality of central conductors are at least partly interleaved with the strip conductors constituting another one of said plurality of central conductors.

10. A central electrode assembly according to claim 9, further comprising a third central conductor overlapping said one and said other central conductors so as to define predetermined angles therebetween.

11. A central electrode assembly according to claim 10, wherein said third central conductor is formed of a respective plurality of strip conductors extending in a same direction, said strip conductors of said third central conductor being stacked sequentially with but not alternately with said respective strip conductors of said one and said other central conductors.

12. A central electrode assembly according to claim 9, wherein the strip conductors constituting said one of said plurality of central conductors are alternately stacked with the strip conductors constituting said another one of said plurality of central conductors.

13. A central electrode assembly according to claim 9, further comprising a second ferrite disposed opposite said ferrite so as to sandwich said overlapping portion of said plurality of central conductors.

* * * * *